United States Patent [19]

Fernandez Sanz

[11] Patent Number: 4,570,795

[45] Date of Patent: Feb. 18, 1986

[54] SUPPORT FOR JARS

[76] Inventor: Ignacio Fernandez Sanz, Autopista de Malaga, Km 3, Granada, Spain

[21] Appl. No.: 566,205

[22] Filed: Dec. 28, 1983

[30] Foreign Application Priority Data

Apr. 21, 1983 [ES] Spain ..... 271:616

[51] Int. Cl.[4] ..... B65D 65/12; B65D 71/00

[52] U.S. Cl. ..... 206/430; 206/434; 229/40; 229/87 R

[58] Field of Search ..... 206/139, 140, 145–147, 206/151–155, 158, 199, 426, 427, 429–431, 434, 486, 490, 499, 503, 526; 229/40, 87 F, 87 R

[56] References Cited

U.S. PATENT DOCUMENTS

| | | | |
|---|---|---|---|
| 2,033,526 | 3/1936 | Kinkenon | 229/87 R |
| 3,166,190 | 1/1965 | Conrades | 206/140 |
| 3,443,681 | 5/1969 | Wysocki | 206/44 R |
| 3,561,594 | 2/1971 | Jorgensen | 206/431 |
| 3,756,394 | 9/1973 | Huault | 206/431 |
| 3,773,170 | 11/1973 | Rossi | 229/40 |

FOREIGN PATENT DOCUMENTS

| | | | |
|---|---|---|---|
| 1423002 | 11/1965 | France | 206/430 |
| 1436935 | 3/1966 | France | 206/431 |
| 2250342 | 5/1975 | France | 206/486 |
| 1084182 | 9/1967 | United Kingdom | 206/147 |

*Primary Examiner*—George E. Lowrance
*Assistant Examiner*—Jimmy G. Foster
*Attorney, Agent, or Firm*—Ostrolenk, Faber, Gerb & Soffen

[57] ABSTRACT

A support of a folded sheet for supporting two rows of jars. The support has a row of openings intermediate its ends and one row of the jars project through the openings. At each side of the row of openings is a respective pair of fold lines. The fold lines have respective slots along them for receiving therein the edges of supported jars. The slots in the fold lines closer to the openings receive the edges of the jars projecting through the openings. The slots in the fold lines further from the openings receive the edges of jars which are disposed in the space inside the folded support above the first-mentioned jars. A tab-in-slot connection holds the support folded.

7 Claims, 3 Drawing Figures

SUPPORT FOR JARS

BACKGROUND OF THE INVENTION

The present invention relates to a support for jars. Individual jars, particularly ones containing a single portion of a food, are of great convenience in use and afford a high degree of hygiene protection for the product. This has led to considerable expansion in the use of such jars. However, they have the drawback that it is necessary to handle a large number of jars in order to transport a given quantity of product, which would not be the case if a single container of larger size were used. This results in inconvenience for the user, particularly for transportation of the product from the place of purchase to the place of consumption.

It is therefore convenient to use devices which make it possible to handle several jars effectively in a single package. These devices, however, should not be of great weight nor of a complexity which would unfavorably affect the total cost of the product. The devices must also provide perfect visibility of the jars which they contain, since this is important from the standpoint of the sale thereof on racks and display counters.

SUMMARY OF THE INVENTION

It is the object of the present invention to meet all the above-mentioned requirements.

The support of the invention comprises a sheet of cardboard, plastic or similar material, which is folded and bent on itself in order to secure several jars, and particularly two row of jars within it. Its cost of manufacture is very low, especially because it consists of a single piece and the operations of placing the jars within it are simple and can easily be performed automatically. Furthermore, the support permits perfect visibility of the jars.

As noted above, the support is comprised of a single foldable sheet. The sheet has opposite first end sections which are intended to be brought together as the sheet is folded. Appropriate securing means hold the sheet with its first end sections brought together. There is at least one and more usually two openings in a row extending across the sheet between its second ends, which join the first end sections. A jar may project through each opening, and its edge would be just above the opening.

At the opposite sides of the opening or row of openings, a respective pair of fold lines are defined in the sheet, at which the sheet may be folded. The fold lines also extend between the second ends of the sheet. In each fold line, there is a respective slot, and each slot is adapted to support the edge of a supported jar. The first slots in the first fold lines, which are the fold lines close to the openings, are generally positioned with respect to the opening so that they can hold the edge of a jar located in the opening. The second slots in the second fold lines, which are the fold lines further from the openings, preferably are aligned along their fold lines with the slots in the first fold lines, although this is not required. The second slots also hold the edges of jars. When the support is folded along the first and second fold lines, a first jar is held by first slots in the first fold lines and projects through a respective opening in the sheet. A second jar is supported in the space defined in the support between the first and second fold lines and the edge of the second jar is held in the second slots in the second fold line. In this way, the support carries a stack of two jars or two stacked rows of jars.

Other objects and features of the invention will become apparent from the following description of a preferred embodiment, shown in the accompanying drawings.

DESCRIPTION OF THE PREFERRED EMBODIMENT

The support is formed from a sheet of cardboard, plastic or any material capable of being folded along a few fold lines. The sheet is shown in a developed, unfolded view in FIG. 1.

Figure 1:
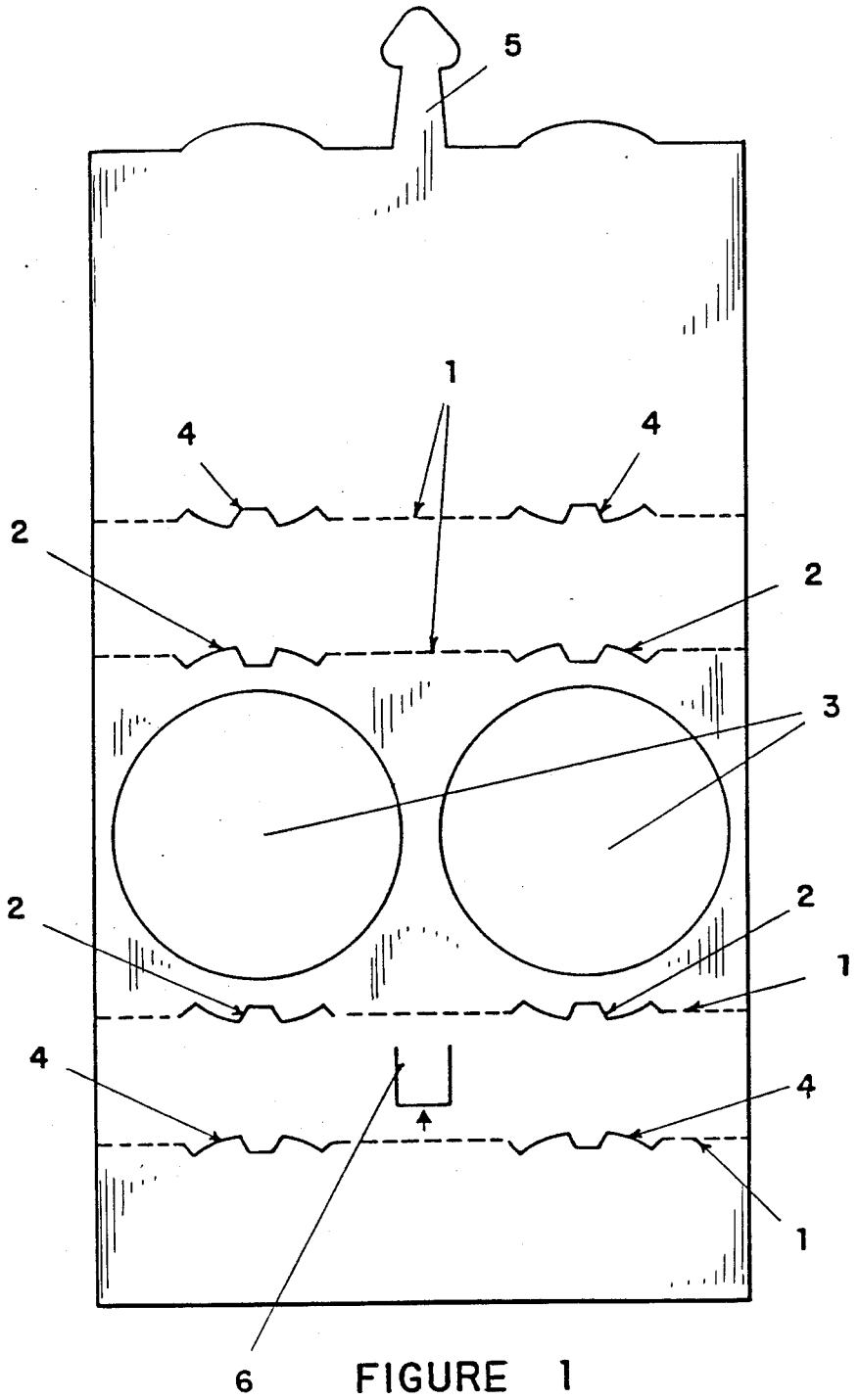
FIG. 1 is a developed, unfolded view of a support according to the invention.

As shown in FIG. 1, the support comprises a rectangular sheet having first end sections at its top and bottom. The top end section carries a projecting tab 5. The bottom end section, in contrast, has a cutout slot 6 adapted to receive the tab 5 when the sheet is folded over to define the support. The sheet has second side edges which join the first sections.

Generally midway between the first end sections, there is a row of openings 3 through the sheet, each for holding a respective jar.

At both sides of the row of openings, there is a respective pair of fold lines, at which the sheet is folded to create the support. The fold lines each extend across the board, are parallel and are grouped in two pairs, symmetrically located and spaced from opposite sides of the row of jar openings 3. The first fold lines 1 which are nearer the opening each include a respective pair of slots 2 therein which are shaped and positioned so that the upper edge of a jar 7 will project through the opening 3 and be received in the respective slots 2 at that opening 3, while the jar extends beneath the support through the opening.

Each of the second, more outward fold lines 1 includes respective slots 4 which also receive the edges of jars 7. The pair of fold lines at each side of the row of openings 3 are spaced apart about the height of a jar 7, so that a jar 7, which is seated atop another jar in an opening 3, will have the upper edge thereof at the outermost fold lines 1 and the upper edge of such jars will be received in the slots 4 in the outermost fold lines. As a result, two separate rows of jars may be supported, one row above the other, in the single support. The shapes of the slots 2 and 4 are rounded, notched, etc., for providing effective engagement with the edges of the supported jars. The slots are spaced in from the opposite second edges of the sheet to rigidify the sheet around the slots so that the sheet will support the jars. The support is formed by folding the sheet along four dashed lines 1.

Once the edges of all four jaws have been secured in the corresponding slots 2 and 4, the sheet is folded along the lines 1 until the tab 5 is introduced into the slot 6 (in the direction indicated by the arrow). The width of the end of the tab 5 is slightly greater than the width of the slot 6 so as to prevent the tab from disengaging itself.

Figure 2:
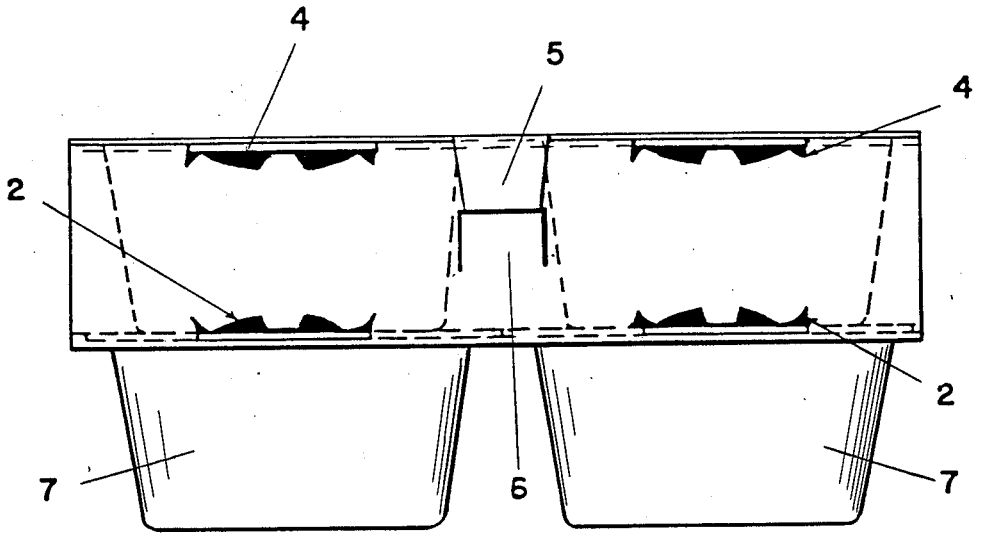
FIG. 2 is a front view of the support folded into the closed condition and supporting jars.
Figure 3:
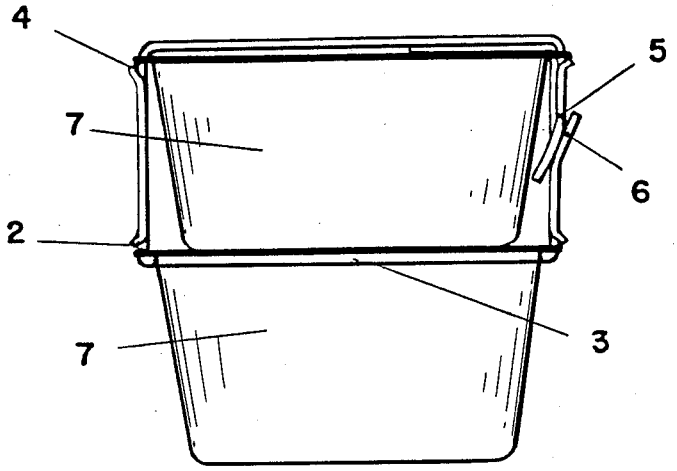
FIG. 3 is a side view of the support holding jars.

FIGS. 2 and 3 show a front and side elevation respectively of the assembled support.

The jars 7 which are secured in the slots 2 project down through the openings 3. The other two jars remaining within the support are seated atop the first two jars.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A support for jars, comprising a single foldable sheet, the foldable sheet comprising:

a central section; a first pair of spaced apart fold lines at opposite sides of the central section; the central section having at least one opening formed therein, the opening being located between and spaced from each of the first pair of fold lines;

a respective first slot being formed in each of the first fold lines and positioned for receiving an edge of a jar projecting through the opening when the sheet is folded along the respective first fold line;

two side sections, each joining the central section at a respective one of the first fold lines; a second pair of fold lines, each respective second fold line being at a side of the respective side section opposite the respective first fold line;

a respective second slot being formed in each of the second fold lines and positioned for receiving an edge of a jar seated atop the jar projecting through the opening when the sheet is folded along the respective second fold line;

two opposite end sections, each joining a respective one of the side sections at the respective second fold line, the opposite end sections being brought together when the sheet is folded along both the first and second fold lines; and securing means for holding the sheet folded with the end sections together.

2. The support of claim 1, wherein there are a plurality of the openings in the central section of the sheet in a row between the first fold lines;

a respective first slot in each of the first fold lines being located generally at each one of the openings for supporting a respective jar at the respective opening.

3. The support of claim 1, wherein the securing means comprises a tab on one end section and a cooperating slot in the other end section, the slot being for receiving and removably retaining the tab in the slot.

4. The support of claim 1, wherein the first slots in the first fold lines are at the same positions along the first fold lines as the second slots are along the second fold lines.

5. The support of claim 4, wherein the fold lines are parallel.

6. The support of claim 5, wherein there are a plurality of the openings in the central section of the sheet arrayed in a row between the first fold lines, which row of openings is parallel to the fold lines;

a respective first slot in each of the first fold lines being located generally at each one of the openings;

a respective second slot in each of the second fold lines being located generally at the same position along the respective second fold line as the respective first slot is along the respective first fold line.

7. In combination, the support of claim 1 and first and second jars;

the sheet of the support being folded at the first and second fold lines and being held folded by the securing means; the side sections of the sheet each having a spacing between the respective first and second fold lines of about the height of the second jar;

the first jar projecting through the opening in the central section and having one edge received in the first slots; the second jar being seated atop the first jar and having an edge received in the second slots.

* * * * *